US012612759B2

(12) United States Patent
Fuerstenberg

(10) Patent No.: US 12,612,759 B2
(45) Date of Patent: Apr. 28, 2026

(54) DUMP LINER DEVICE

(71) Applicant: Glenn Fuerstenberg, Sioux Falls, SD (US)

(72) Inventor: Glenn Fuerstenberg, Sioux Falls, SD (US)

( * ) Notice: Subject to any disclaimer, the term of this patent is extended or adjusted under 35 U.S.C. 154(b) by 285 days.

(21) Appl. No.: 18/382,416

(22) Filed: Oct. 20, 2023

(65) Prior Publication Data

US 2025/0012041 A1 Jan. 9, 2025

Related U.S. Application Data

(63) Continuation-in-part of application No. 18/218,862, filed on Jul. 6, 2023.

(51) Int. Cl.
*E02F 3/407* (2006.01)

(52) U.S. Cl.
CPC ..... *E02F 3/407* (2013.01)

(58) Field of Classification Search
None
See application file for complete search history.

(56) References Cited

U.S. PATENT DOCUMENTS

| | | | | |
|---|---|---|---|---|
| 3,035,724 | A * | 5/1962 | Clark | E02F 3/34 37/444 |
| 3,675,349 | A | 7/1972 | Luck | |
| 4,151,664 | A | 5/1979 | Maura | |
| 4,225,283 | A | 9/1980 | Baker | |
| 4,845,867 | A | 7/1989 | Albrecht | |
| 7,712,234 | B2 | 5/2010 | Striegel | |
| 2007/0107270 | A1 | 5/2007 | Edmond | |
| 2021/0332568 | A1 * | 10/2021 | Bjerke | E02F 3/8157 |

* cited by examiner

*Primary Examiner* — Christopher J Sebesta
*Assistant Examiner* — Alfred H Tsui
(74) *Attorney, Agent, or Firm* — Eser

(57) ABSTRACT

A dump liner device includes a bucket having a concave interior surface extending between a high side and a low side. The bucket is movable between a dumping position and a holding position. A panel has a static connection edge, a loose connection edge, and a lining surface extending between the static connection edge and the loose connection edge. The panel is flexible and conforms to the interior surface of the bucket when the bucket is in the holding position. The panel is unconnected to the bucket between the static connection edge and the loose connection edge such that the panel is gravitationally urged away from the interior surface of the bucket when the bucket is moved into the dumping position.

17 Claims, 5 Drawing Sheets

DUMP LINER DEVICE

CROSS-REFERENCE TO RELATED APPLICATIONS

This application is a continuation in part and I hereby claim the benefit under 35 U.S.C., Section 120 of U.S. application Ser. No. 18/218,862 filed Jul. 6, 2023.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to dump devices and more particularly pertains to a new liner for a dumping device to promote full emptying and prevent debris buildup within a bucket used to collect and dump material such as dirt, rocks, particulate material, or the like.

(2) Description of Related Art Including Information Disclosed Under 37 CFR 1.97 and 1.98

The prior art relates to dump devices such as a bucket for a backhoe. Known prior art lacks a liner attached to the bucket or tub to prevent retention or buildup of debris in the bucket.

BRIEF SUMMARY OF THE INVENTION

An embodiment of the disclosure meets the needs presented above by generally comprising a bucket having a high side and a low side. The high side is defined by being elevationally higher than the low side when the bucket is in a dumping position. The bucket has a concave interior surface extending between the high side and the low side wherein the bucket is configured for holding material in the bucket when the bucket is in a holding position. The bucket is movable between the dumping position and the holding position. A panel has a static connection edge, a loose connection edge, and a lining surface extending between the static connection edge and the loose connection edge. The static connection edge is coupled to the bucket proximate to the low side of the bucket. The panel is flexible whereby the panel extends into and conforms to the interior surface of the bucket extending from the low side towards the high side when the bucket is the holding position. The panel is unconnected to the bucket between the static connection edge and the loose connection edge wherein the panel is gravitationally urged away from the interior surface of the bucket when the bucket is moved into the dumping position. Thus, the panel is configured to facilitate dumping of the material from the bucket as the bucket is moved into the dumping position from the holding position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
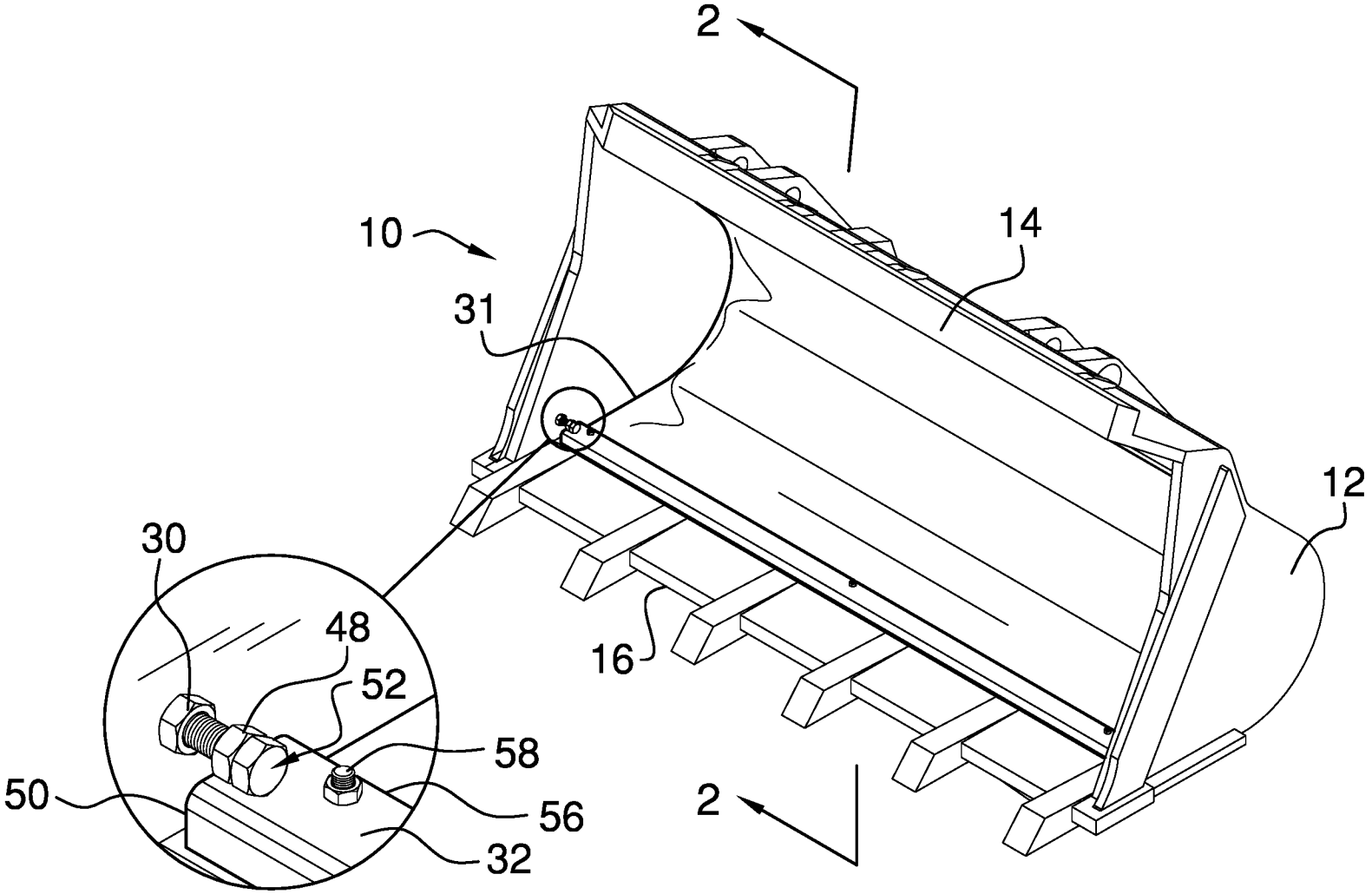
FIG. 1 is a top front side perspective view of a dump liner device according to an embodiment of the disclosure.
Figure 2:
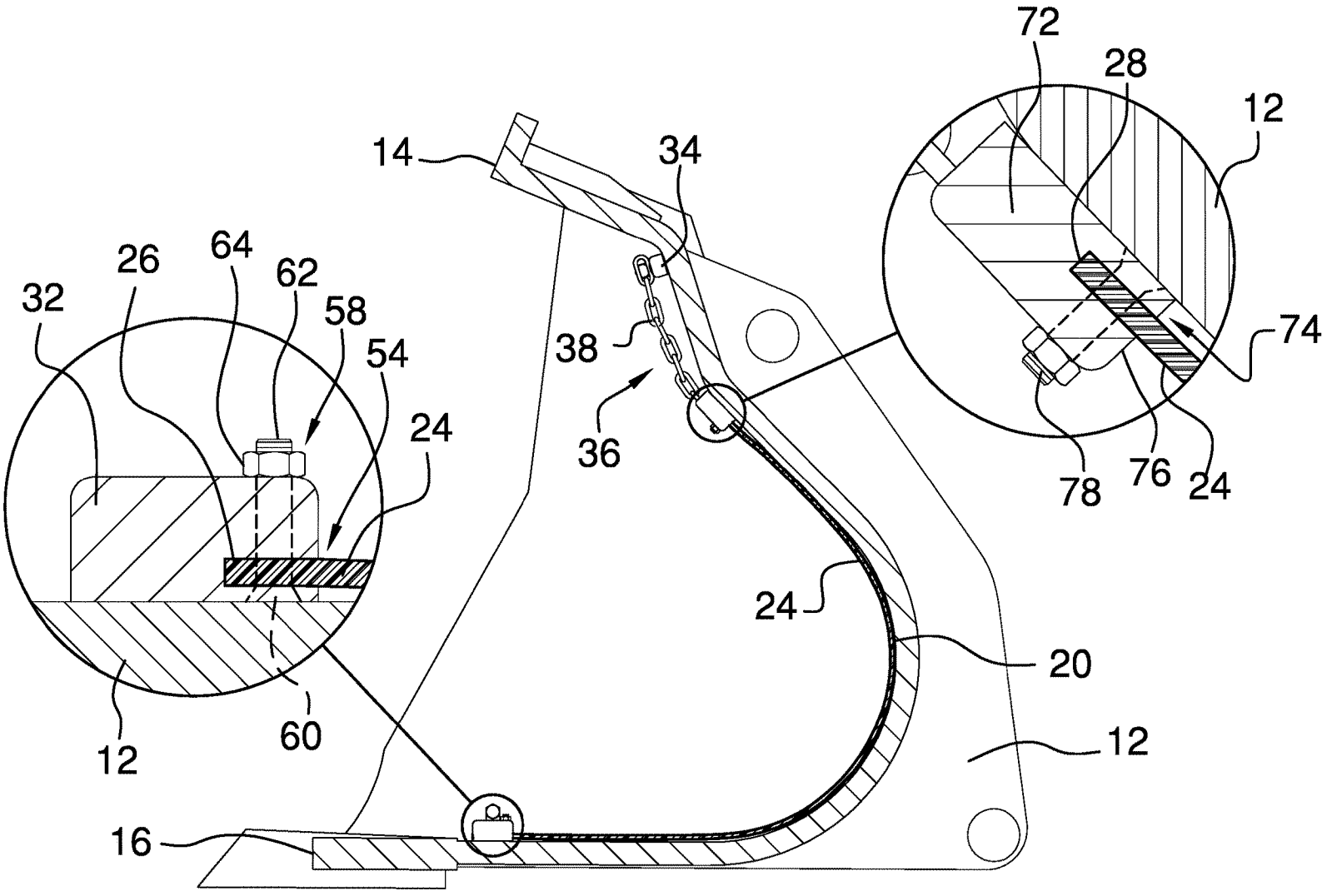
FIG. 2 is a cross-sectional view of an embodiment of the disclosure taken along line 2-2 of FIG. 1.
Figure 4:
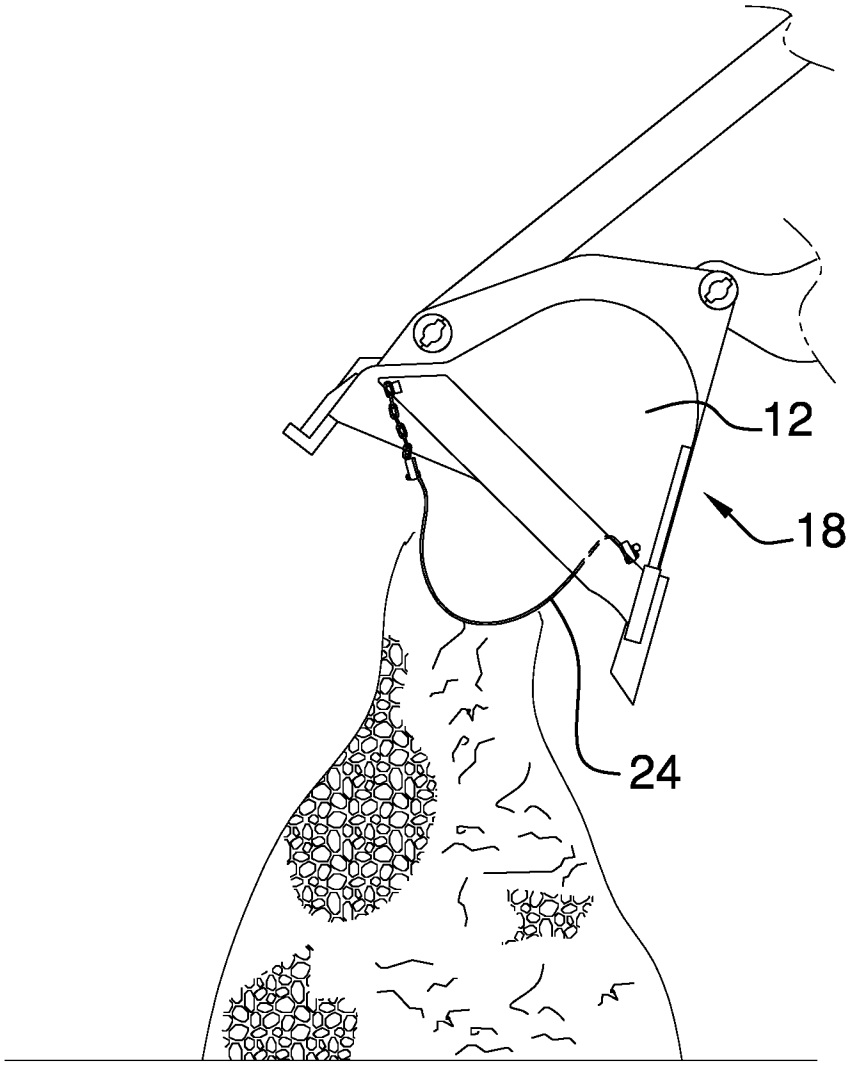
FIG. 4 is a side view of an embodiment of the disclosure in use.
Figure 3:
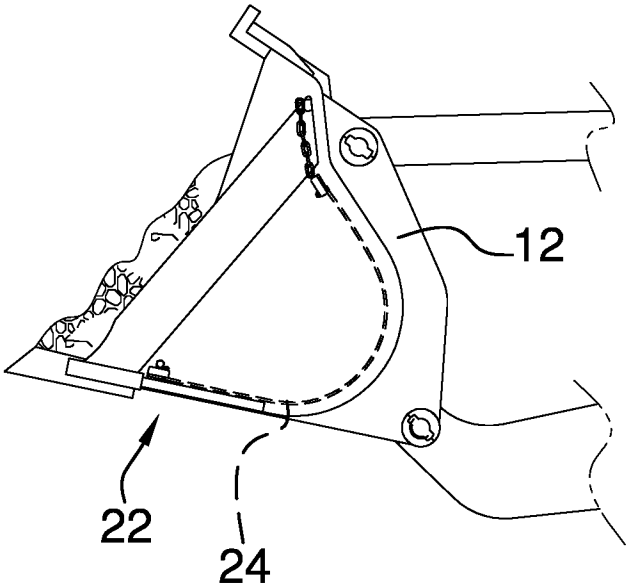
FIG. 3 is a side view of an embodiment of the disclosure in use.
Figure 5:
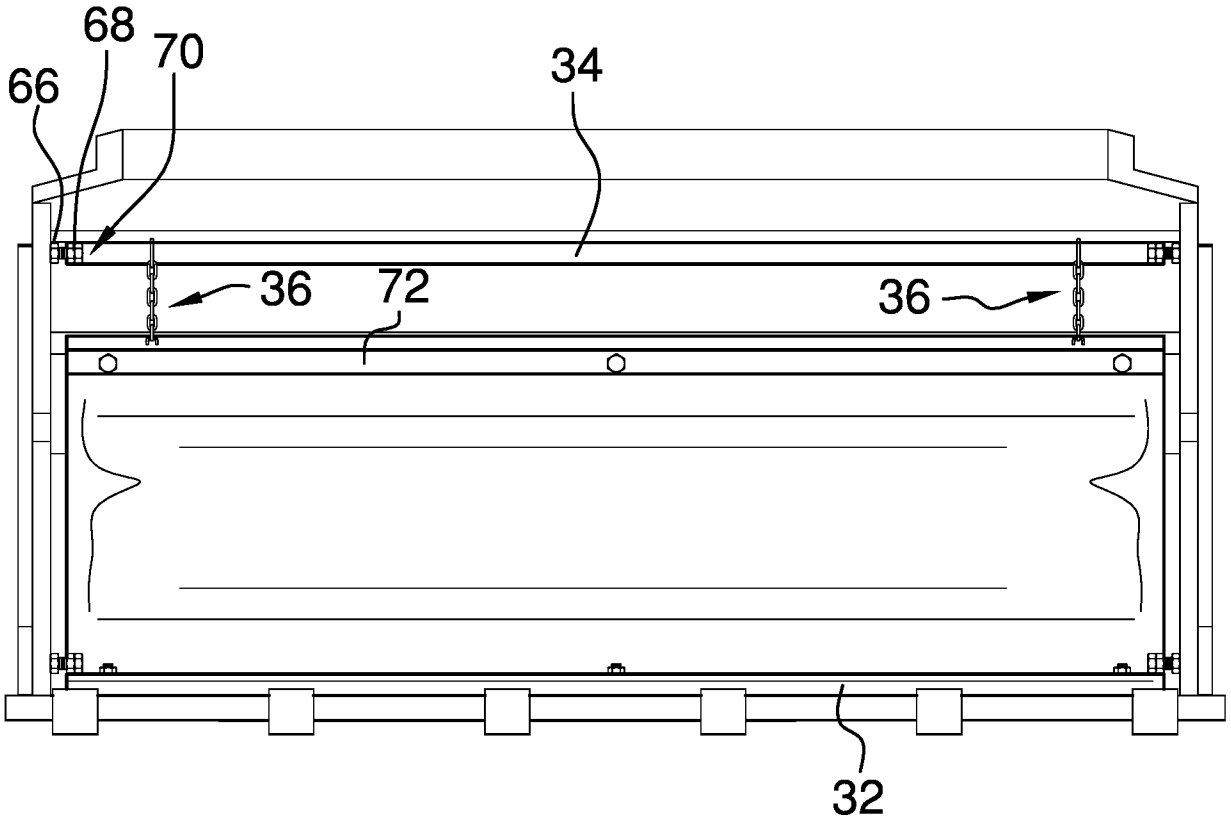
FIG. 5 is a side view of an embodiment of the disclosure in use.
Figure 6:
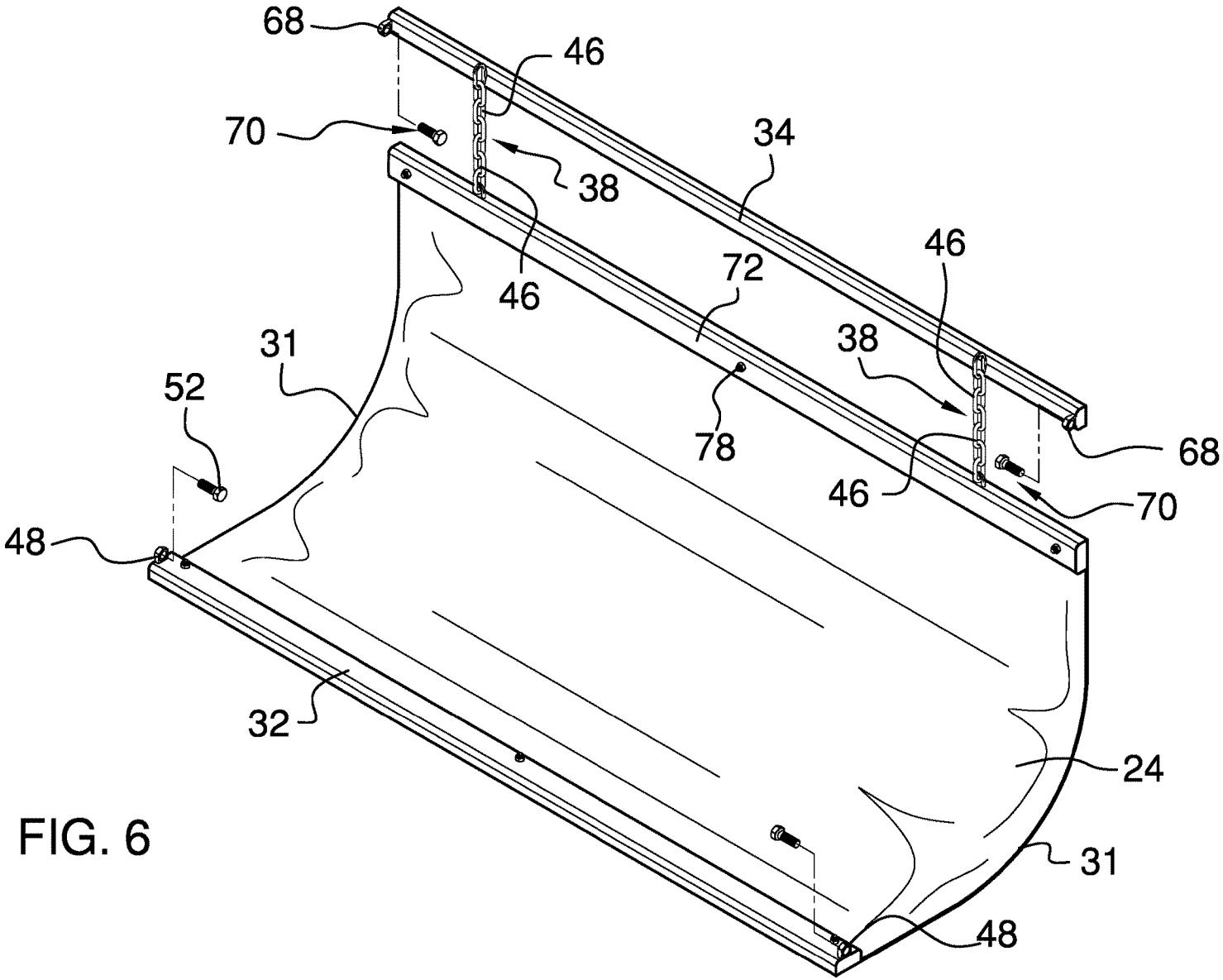
FIG. 6 is a rear view of an embodiment of the disclosure in use.

With reference now to the drawings, and in particular to FIGS. 1 through 6 thereof, a new dump device embodying the principles and concepts of an embodiment of the disclosure and generally designated by the reference numeral 10 will be described.

As best illustrated in FIGS. 1 through 6, the dump liner device 10 generally comprises a bucket 12 having a high side 14 and a low side 16. The high side 14 is defined by being elevationally higher than the low side 16 when the bucket 12 is in a dumping position 18. The bucket 12 has a concave interior surface 20 extending between the high side 14 and the low side 16 wherein the bucket 12 is configured for holding material in the bucket 12 when the bucket 12 is in a holding position 22. The bucket 12 is movable between the dumping position 18 and the holding position 22. A panel 24 has a static connection edge 26, a loose connection edge 28, and a lining surface 30 extending between the static connection edge 26 and the loose connection edge 28. The static connection edge 26 is coupled to the bucket 12 proximate to the low side 16 of the bucket 12. The panel 24 is flexible whereby the panel 24 extends into and conforms to the interior surface 20 of the bucket 12 extending from the low side 16 towards the high side 14 when the bucket 12 is the holding position 22. The panel 12 is unconnected to the bucket 12 between the static connection edge 26 and the loose connection edge 28 wherein the panel 24 is gravitationally urged away from the interior surface 20 of the bucket 12 when the bucket 12 is moved into the dumping position 18. Thus, the panel 24 is configured to facilitate dumping of the material from the bucket 12 as the bucket 12 is moved into the dumping position 18 from the holding position 22. The panel 24 has a width between lateral edges 31 of the panel 24 coextensive with a width of the interior surface 20 of the bucket 12. The panel 24 is constructed of rubber or the like. The static connection edge 26 of the panel 24 is parallel to the loose connection edge 28 of the panel 24.

Each of a pair of lower receivers 30 is coupled to the bucket 12. A lower bar 32 is coupled to the static connection edge 26 of the panel 24. The lower bar 32 is couplable to the pair of lower receivers 30 wherein the static connection edge 26 is secured in a static position relative to the bucket 12. Similarly, an upper beam is coupled 34 to the bucket 12. The upper beam 34 is positioned proximate to the high side 14 of the bucket 12. A restraint 36 couples the loose connection edge 28 of the panel 24 to the upper beam 34. The restraint 36 is a chain 38 having a first end 40 coupled to the upper beam 34 and a second end 42 coupled to the panel 24. The restraint 36 may be one restraint 36 or a pair of restraints 36. When at least a pair of restraints 36 are implemented, each of a pair of the restraints 36 is coupled adjacent to a respective end 44 of the upper beam 34. The chain 38 may have a plurality of links 46. A selectable number of the links 46 is couplable between the upper beam 34 and the loose connection edge 28 wherein a length of the chain 38 between the upper beam 34 and the loose connection edge 28 of the panel 24 is adjustable.

Each of the lower receivers 30 is coupled to the bucket 12 adjacent to the low side 14. Each of a pair of lower bar loops 48 is coupled to the lower bar 32. Each of the lower bar loops 48 is positionable to align with an associated one of the lower receivers 30. Each of the lower bar loops 48 may be positioned flush with a respective end 50 of the lower bar 32. Each of a pair of lower bar bolts 52 is extendable through an associated one of the lower bar loops 48 and engageable to the associated one of the lower receivers 30 whereby the pair of lower bar bolts 52 secure the lower bar 32 to the bucket 12 A lower bar slot 54 extends into a longitudinal side 56 of the lower bar 32. The static connection edge 26 is positionable in the lower bar slot 54. Each of a plurality of lower bar fasteners 58 is engageable to the lower bar 32 such that the lower bar fastener 58 extends into the lower bar slot 54. Thus, the lower bar fastener 58 secures the panel 24 to the lower bar 32. Each lower bar fastener 58 has a lower bar head 60 inset into the lower bar 32 when the lower bar fastener 58 is fully inserted into the lower bar 32. Each lower bar fastener 58 extends fully through the lower bar 32 wherein a threaded portion 62 of the lower bar fastener 58 is exposed extending from the lower bar 32. Each of a plurality of lower bar nuts 64 is engageable to the threaded portion 62 of a respective one of the lower bar fasteners 58.

Similarly, each of a pair of upper receivers 66 is coupled to the bucket 12 closer to the high side 16 than the low side 14. Each of a pair of beam loops 68 is coupled to the upper beam 34. Each of the beam loops 68 is positionable to align with an associated one of the upper receivers 66. Each of a pair of upper beam bolts 70 is extendable through an associated one of the beam loops 68 and engageable to the associated one of the upper receivers 66. Thus, the pair of beam bolts 70 secure the upper beam 34 to the bucket 12. An upper bar 72 is coupled to the loose connection edge 28 of the panel 24. The plurality of restraints 36 is coupled to the upper bar 72. An upper bar slot 74 extends into a longitudinal side 76 of the upper bar 72. The loose connection edge 28 is positionable in the upper bar slot 74. Each of a plurality of upper bar fasteners 78 is engageable to the upper bar 72 such that the upper bar fastener 78 extends into the upper bar slot 74 whereby the upper bar fastener 78 secures the panel 24 to the upper bar 72.

In use, the panel 24 is coupled to the bucket 12 in a manner such that gravity pulls the panel 24 away from the interior surface 20 of the bucket 12 when the bucket 12 is moved into the dumping position 18. The loose connection edge 28 is tethered to the bucket 12 by the restraints 36 but loose to allow the panel 24 to move outwardly clearing material from the bucket 12. The sizing of the panel 24 relative to the bucket 12 prevents buildup and frictional engagement of the material to the interior surface 20 of the bucket 12. The length of the restraints 36 can be adjusted to further facilitate full clearing of the bucket 12 while allowing the panel 24 to return to a position lining the interior surface 20 of the bucket 12 upon returning the bucket 12 to the holding position 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dump liner system comprising:

a bucket having a high side and a low side, said high side being defined by being elevationally higher than said low side when said bucket is in a dumping position, said bucket having a concave interior surface extending between said high side and said low side wherein said bucket is configured for holding material in said bucket when said bucket is in a holding position, said bucket being movable between said dumping position and said holding position;

a panel having a static connection edge, a loose connection edge, and a lining surface extending between said static connection edge and said loose connection edge, said static connection edge being coupled to said bucket proximate to said low side of said bucket, said panel being flexible whereby said panel extends into and conforms to said interior surface of said bucket extending from said low side towards said high side when the bucket is the holding position, said panel being unconnected to said bucket between said static connection edge and said loose connection edge wherein said panel is gravitationally urged away from said interior surface of said bucket when said bucket is moved into said dumping position wherein said panel is configured to facilitate dumping of the material from said bucket as said bucket is moved into said dumping position from said holding position; and a restraint coupling said loose connection edge of said panel to said bucket such that said loose connection edge is positioned within said bucket in the holding position.

2. The dump liner system of claim 1, further comprising:

a pair of lower receivers coupled to said bucket;

a lower bar coupled to said static connection edge of said panel, said lower bar being couplable to said pair of lower receivers wherein said static connection edge is secured in a static position relative to said bucket.

3. The dump liner system of claim 1, further comprising:

an upper beam coupled to said bucket, said upper beam being positioned proximate to said high side of said bucket said restraint coupling said loose connection edge of said panel to said upper beam.

4. The dump liner system of claim 3, further comprising said restraint being a chain having a first end coupled to said upper beam and a second end coupled to said panel.

5. The dump liner system of claim 3, further comprising said restraint being one restraint of a pair of restraints, each restraint being coupled adjacent to a respective end of said upper beam.

6. The dump liner system of claim 1, further comprising said panel having a width between lateral edges of said panel coextensive with a width of said interior surface of the bucket.

7. The dump liner system of claim 1, further comprising said panel being constructed of rubber.

8. The dump liner system of claim 1, further comprising said static connection edge of said panel being parallel to said loose connection edge of said panel.

9. The dump liner system of claim 4, further comprising said chain having a plurality of links, a selectable number of said links being couplable between said upper beam and said loose connection edge wherein a length of said chain between said upper beam and said loose connection edge of said panel is adjustable.

10. The dump liner system of claim 2, further comprising:

a pair of lower receivers, each of said lower receivers being coupled to said bucket adjacent to said low side;

a pair of lower bar loops coupled to said lower bar, each of said lower bar loops being positionable to align with an associated one of said lower receivers; and a pair of bolts, each of said bolts being extendable through an associated one of said lower bar loops and engageable to said associated one of said lower receivers whereby said pair of bolts secure said bar to said bucket.

11. The dump liner system of claim 10, further comprising each of said lower bar loops being positioned flush with a respective end of said lower bar.

12. The dump liner system of claim 1, further comprising:

a lower bar slot extending into a longitudinal side of said lower bar, said static connection edge being positionable in said lower bar slot; and a plurality of lower bar fasteners, each of said lower bar fasteners being engageable to said lower bar such that said lower bar fastener extends into said lower bar slot whereby said lower bar fastener secures said panel to said lower bar.

13. The dump liner system of claim 12, further comprising:

each lower bar fastener having a head inset into said lower bar when said lower bar fastener is fully inserted into said lower bar, each lower bar fastener extending fully through said lower bar wherein a threaded portion of said lower bar fastener is exposed extending from said lower bar; and a plurality of nuts, each nut being engageable to said threaded portion of a respective one of said lower bar fasteners.

14. The dump liner system of claim 3, further comprising:

a pair of upper receivers, each of said upper receivers being coupled to said bucket closer to said high side than said low side;

a pair of beam loops coupled to said upper beam, each of said beam loops being positionable to align with an associated one of said upper receivers; and a pair of upper beam bolts, each of said upper beam bolts being extendable through an associated one of said beam loops and engageable to said associated one of said upper receivers whereby said pair of beam bolts secure said upper beam to said bucket.

15. The dump liner system of claim 3, further comprising an upper bar coupled to said loose connection edge of said panel, said plurality of restraints being coupled to said upper bar.

16. The dump liner system of claim 15, further comprising:

an upper bar slot extending into a longitudinal side of said upper bar, said loose connection edge being positionable in said upper bar slot; and a plurality of upper bar fasteners, each of said upper bar fasteners being engageable to said upper bar such that said upper bar fastener extends into said upper bar slot whereby said upper bar fastener secures said panel to said upper bar.

17. A dump liner system comprising:

a bucket having a high side and a low side, said high side being defined by being elevationally higher than said low side when said bucket is in a dumping position, said bucket having a concave interior surface extending between said high side and said low side wherein said bucket is configured for holding material in said bucket when said bucket is in a holding position, said bucket being movable between said dumping position and said holding position; and a panel having a static connection edge, a loose connection edge, and a lining surface extending between said static connection edge and said loose connection edge, said static connection edge being coupled to said bucket proximate to said low side of said bucket, said panel being flexible whereby said panel extends into and conforms to said interior surface of said bucket extending from said low side towards said high side when the bucket is the holding position, said panel being unconnected to said bucket between said static connection edge and said loose connection edge wherein said panel is gravitationally urged away from said interior surface of said bucket when said bucket is moved into said dumping position wherein said panel is configured to facilitate dumping of the material from said bucket as said bucket is moved into said dumping position from said holding position, said panel having a width between lateral edges of said panel coextensive with a width of said interior surface of the bucket, said panel being constructed of rubber, said static connection edge of said panel being parallel to said loose connection edge of said panel;

a pair of lower receivers coupled to said bucket;

a lower bar coupled to said static connection edge of said panel, said lower bar being couplable to said pair of lower receivers wherein said static connection edge is secured in a static position relative to said bucket;

an upper beam coupled to said bucket, said upper beam being positioned proximate to said high side of said bucket; and a restraint coupling said loose connection edge of said panel to said upper beam, said restraint being a chain having a first end coupled to said upper beam and a second end coupled to said panel, said restraint being one restraint of a pair of restraints, each restraint being coupled adjacent to a respective end of said upper beam, said chain having a plurality of links, a selectable number of said links being couplable between said upper beam and said loose connection edge wherein a length of said chain between said upper beam and said loose connection edge of said panel is adjustable;

a pair of lower receivers, each of said lower receivers being coupled to said bucket adjacent to said low side;

a pair of lower bar loops coupled to said lower bar, each of said lower bar loops being positionable to align with an associated one of said lower receivers, each of said lower bar loops being positioned flush with a respective end of said lower bar;

a pair of bolts, each of said bolts being extendable through an associated one of said lower bar loops and engageable to said associated one of said lower receivers whereby said pair of bolts secure said bar to said bucket;

a lower bar slot extending into a longitudinal side of said lower bar, said static connection edge being positionable in said lower bar slot; and a plurality of lower bar fasteners, each of said lower bar fasteners being engageable to said lower bar such that said lower bar fastener extends into said lower bar slot whereby said lower bar fastener secures said panel to said lower bar, each lower bar fastener having a lower bar head inset into said lower bar when said lower bar fastener is fully inserted into said lower bar, each lower bar fastener extending fully through said lower bar wherein a threaded portion of said lower bar fastener is exposed extending from said lower bar;

a plurality of lower bar nuts, each lower bar nut being engageable to said threaded portion of a respective one of said lower bar fasteners;

a pair of upper receivers, each of said upper receivers being coupled to said bucket closer to said high side than said low side;

a pair of beam loops coupled to said upper beam, each of said beam loops being positionable to align with an associated one of said upper receivers;

a pair of upper beam bolts, each of said upper beam bolts being extendable through an associated one of said beam loops and engageable to said associated one of said upper receivers whereby said pair of beam bolts secure said upper beam to said bucket;

an upper bar coupled to said loose connection edge of said panel, said plurality of restraints being coupled to said upper bar;

an upper bar slot extending into a longitudinal side of said upper bar, said loose connection edge being positionable in said upper bar slot; and a plurality of upper bar fasteners, each of said upper bar fasteners being engageable to said upper bar such that said upper bar fastener extends into said upper bar slot whereby said upper bar fastener secures said panel to said upper bar.

* * * * *